US008319081B1

(12) United States Patent
Ridge

(10) Patent No.: US 8,319,081 B1
(45) Date of Patent: Nov. 27, 2012

(54) COMBINATION BANJO, BASS, AND GUITAR

(76) Inventor: William David Ridge, Marion, NC (US)

( * ) Notice: Subject to any disclaimer, the term of this patent is extended or adjusted under 35 U.S.C. 154(b) by 0 days.

(21) Appl. No.: 13/067,350

(22) Filed: May 26, 2011

(51) Int. Cl.
*G10D 1/00* (2006.01)

(52) U.S. Cl. ..... 84/263; 84/293; 84/267

(58) Field of Classification Search ..... 84/263, 84/293

See application file for complete search history.

(56) References Cited

U.S. PATENT DOCUMENTS

| | | | | | |
|---|---|---|---|---|---|
| 480,816 | A | * | 8/1892 | Haney | 84/263 |
| 536,634 | A | * | 4/1895 | Kyle | 84/263 |
| 542,788 | A | * | 7/1895 | Almcrantz | 84/263 |
| 616,908 | A | * | 1/1899 | Englund | 84/263 |
| 832,157 | A | * | 10/1906 | Platts | 84/263 |
| 1,131,564 | A | * | 3/1915 | Shutt | 84/263 |
| 1,241,639 | A | * | 10/1917 | Luis | 84/263 |
| 1,554,806 | A | * | 9/1925 | Furia | 84/263 |
| 1,607,449 | A | * | 11/1926 | Edwards | 84/263 |
| 1,618,626 | A | * | 2/1927 | Altpeter | 84/263 |
| D72,433 | S | * | 4/1927 | Montfort | D17/15 |
| 1,634,730 | A | * | 7/1927 | Travaglini | 84/263 |
| 1,828,315 | A | * | 10/1931 | Cavicchioli | 84/263 |
| 2,033,826 | A | * | 3/1936 | Haium | 84/173 |
| 3,130,625 | A | * | 4/1964 | Savona | 84/267 |
| 3,633,452 | A | * | 1/1972 | Beasley | 84/263 |
| D224,841 | S | * | 9/1972 | Dawson | D17/15 |
| 3,783,731 | A | * | 1/1974 | Pash | 84/173 |
| 3,931,753 | A | * | 1/1976 | Dopera | 84/296 |
| 3,956,963 | A | * | 5/1976 | Milton | 84/296 |
| 4,377,101 | A | * | 3/1983 | Santucci | 84/743 |
| 4,450,744 | A | * | 5/1984 | Shubb | 84/731 |
| 4,483,233 | A | * | 11/1984 | Benson | 84/263 |
| D279,195 | S | * | 6/1985 | Perkins | D17/15 |
| 4,738,178 | A | * | 4/1988 | Deering | 84/726 |
| 5,175,387 | A | * | 12/1992 | Greory | 84/267 |
| 5,216,192 | A | * | 6/1993 | Barker | 84/328 |
| 6,114,617 | A | * | 9/2000 | Scheib | 84/312 R |
| 6,156,960 | A | * | 12/2000 | Abrams | 84/269 |
| 6,300,549 | B1 | * | 10/2001 | Gregory | 84/267 |
| 6,346,661 | B1 | * | 2/2002 | Yaskoweak | 84/267 |
| 6,649,818 | B2 | * | 11/2003 | Bailey | 84/293 |
| 7,102,073 | B1 | * | 9/2006 | Isola | 84/723 |
| 7,230,174 | B1 | * | 6/2007 | Wilson | 84/267 |
| 7,579,532 | B2 | * | 8/2009 | Shelton | 84/267 |
| 7,732,702 | B2 | * | 6/2010 | Ludwig | 84/644 |
| 7,994,408 | B1 | * | 8/2011 | Mondell | 84/267 |
| 2008/0210077 | A1 | * | 9/2008 | Boxberger | 84/263 |

* cited by examiner

*Primary Examiner* — Elvin G Enad
*Assistant Examiner* — Robert W Horn

(57) ABSTRACT

This invention is a combination stringed musical instrument like a banjo, bass, and guitar. The invention can be either acoustic or electric. A combination banjo, bass, and guitar and method of playing is provided in which the sixth string is set as a bass string, the fifth string is setup as a banjo fifth string, and the remaining four strings are configured as guitar strings which can be plucked substantially simultaneously by a player, resulting in the simultaneous playing of banjo, bass, and guitar by a single player. Various combinations of string diameters for each part of the combination are disclosed along with options for using a capo or "tunneling" the fifth string at the fifth fret.

1 Claim, 5 Drawing Sheets

COMBINATION BANJO, BASS, AND GUITAR

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention combines three (3) separate stringed musical instruments into one (1) stringed musical instrument.

2. Background

The 5-string banjo, bass, and guitar are now well established stringed musical instruments. The 5-string banjo, bass, and guitar are produced as both electric and non-electric (acoustic) stringed instruments.

SUMMARY OF THE PRESENT INVENTION

The present invention comprises a method for combining the 5-string banjo, bass, and guitar into a single stringed musical instrument. The present invention allows the user to perform musical structures and tones associated with the 5-string banjo, bass, and guitar while playing only the present invention. The present invention is illustrated as an electric model, but the concept also includes non-electric models (acoustic).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

As a preliminary matter, it will readily be understood by one having ordinary skill in the relevant art ("Ordinary Artisan") that the present invention has broad utility and application. Other embodiments also may be discussed for additional illustrative purposes in providing a full and enabling disclosure of the present invention.

While the present invention is described herein in detail in relation to one or more embodiments, it is to be understood that this disclosure is illustrative and exemplary of the present invention, and is made merely for the purposes of providing a full and enabling-disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

Figure 1:
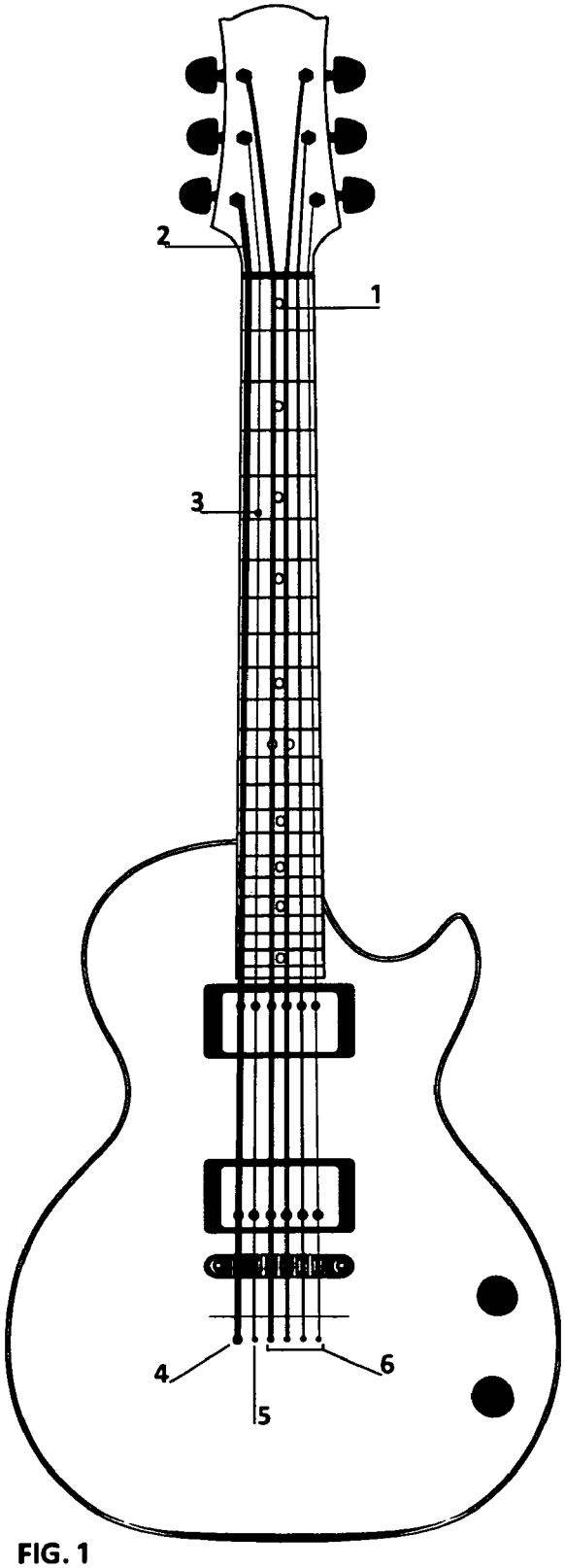
FIG. 1 is an illustration in accordance with a preferred embodiment of the present invention.

FIG. 1 is a diagram illustrating the utility design in accordance with a preferred embodiment of the present invention. The fretboard marker locations are indicated by a circle (1) and are unique to the present invention. Fretboard markers (1) appear at the following fret locations: 1, 3, 5, 7, 10, 12(octave), 15, 17, 19, 22. The headstock (2) illustrated is a basic layout. There are six strings on the present invention and six tuning pegs are required. The fifth string capo location (3) applies to the fifth string at the fifth fret. The sixth string on the present invention (4) is a heavy wound string (bass string). The diameter (gauge) of the sixth string is the largest (heaviest) on the present invention and is recommended to be at least 1.067 mm (0.042) or larger. The fifth string on the present invention (5) is the smallest (lightest) diameter and is recommended to be 0.305 mm (0.012). The remaining strings 4,3,2, and 1 (6) are configured as follows: strings 4 and 3 are wound strings. Strings 2 and 1 are plain steel strings (not wound). The diameter guidelines for string 4: 0.864 mm (0.034). String 3: 0.660 mm (0.026). String 2: 0.406 mm (0.016). String 1: 0.330 min (0.013).

Figure 2:
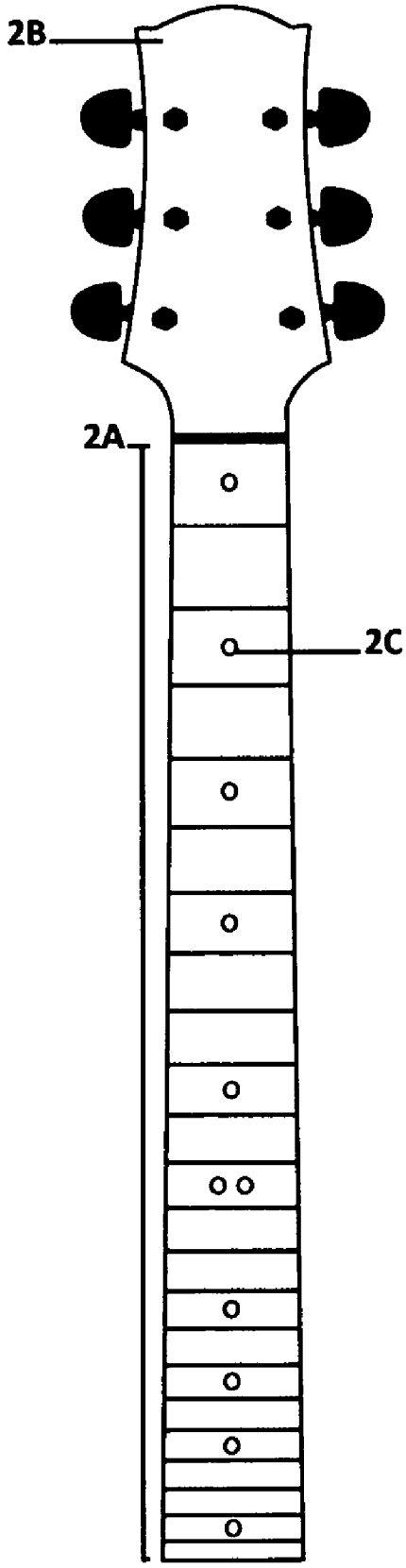
FIG. 2 is an illustration of the headstock and fretboard of the present invention and shows the unique locations of the fretboard markers.

FIG. 2 is a diagram illustrating the neck configuration of the present invention. The scale of the neck (2A) is a standard length for guitar or bass and is comprised of 22 frets. The tuner configuration and headstock as illustrated (2B) is also considered to be a common layout and is configured with 6 tuning pegs (tuners) which are also called tuning machines. The tuning peg for the sixth string must be large enough to accommodate a bass string at least 1.067 mm (0.042). The fretboard marker (2C) locations are unique to the present invention and appear at the following fret locations: 1, 3, 5, 7, 10, 12(octave), 15, 17, 19, 22.

Figure 3:
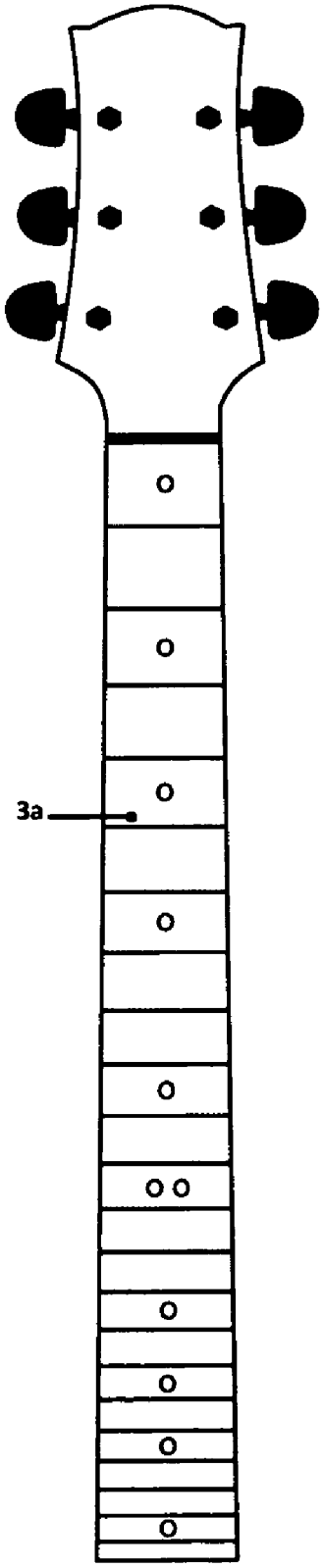
FIG. 3 is an illustration of the capo location at the fifth fret. The capo location applies only to the fifth string on the present invention.

FIG. 3 is a diagram illustrating the location of the fifth string capo (3*a*). Much like a fifth string on the 5-string banjo, the fifth string of the present invention is "capoed" (or depressed) at the fifth fret. There are several methods used for depressing (capoing) the fifth string at the fifth fret. A simple screw or metal staple can be physically embedded into the fretboard to depress the string at the fifth fret. **Alternatively, a metal conduit (tube) can be integrated into the heck under the fretboard where the entry point for the string is located on the headstock. The exit of the conduit would emerge at the fifth fret acting as a capo. This method is commonly known as a "tunneled fifth string" configuration.

Figure 4:
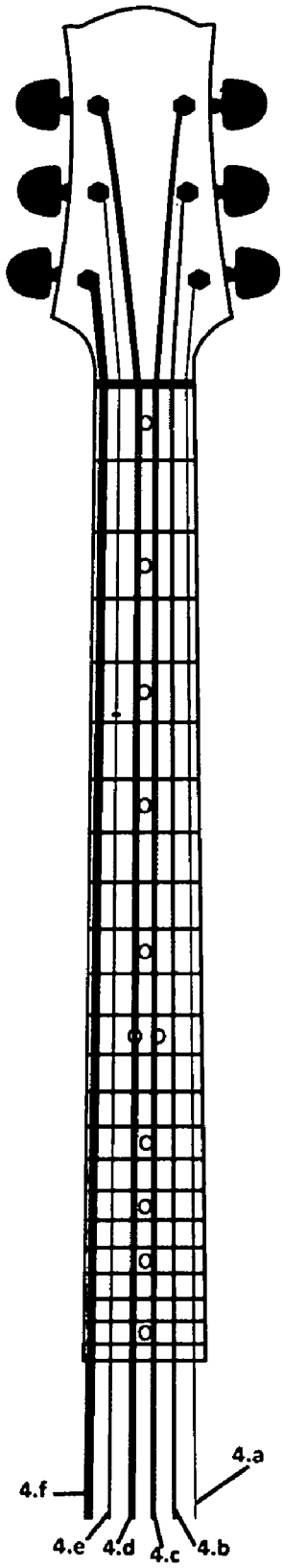
FIG. 4 is an illustration of the string placement sequence (configuration) for the present invention.

FIG. 4 is a diagram illustrating the unique string configuration of the present invention. There are six strings on the present invention and six tuning pegs are required. The fifth string capo location (3) applies to the fifth string at the fifth fret. The sixth string on the present invention (4.*f*) is a heavy wound string (bass string). The diameter (gauge) of the sixth string is the largest (heaviest) on the present invention and is recommended to be at least 1.067 mm (0.042) or larger. The fifth string on the present invention (4.*e*) is the smallest (lightest) diameter and is recommended to be 0.305 mm (0.012). The fifth string (4.*e*) is fixed (or capoed) at the fifth fret. The fourth string (4.*d*) is a wound string and the parameters set the string gauge at 0.864 mm (0.034). The third string (4.*c*) is a wound string and the parameters set the string gauge at 0.660 mm (0.026). The second string (4.*b*) is a plain steel (non-wound) string and the parameters set the string gauge at 0.406 mm (0.016). The first string is a plain steel string and the parameters set the string gauge at 0.330 mm (0.013).

This string configuration is unique to the present invention. The present invention as illustrated is tuned to an open chord. The illustrated tuning includes the following: 6th string (bass) is tuned to an E note, the 5th string is also tuned to an E note (high E), the 4th string is tuned to a B note, the 3rd string is tuned to an E note, the 2nd string is tuned to a G# (A flat) note, the 1st string is tuned to a B note. The present invention is illustrated with a specific tuning (open E Major chord), however, the present invention is capable of accommodating various tunings.

Figure 5:
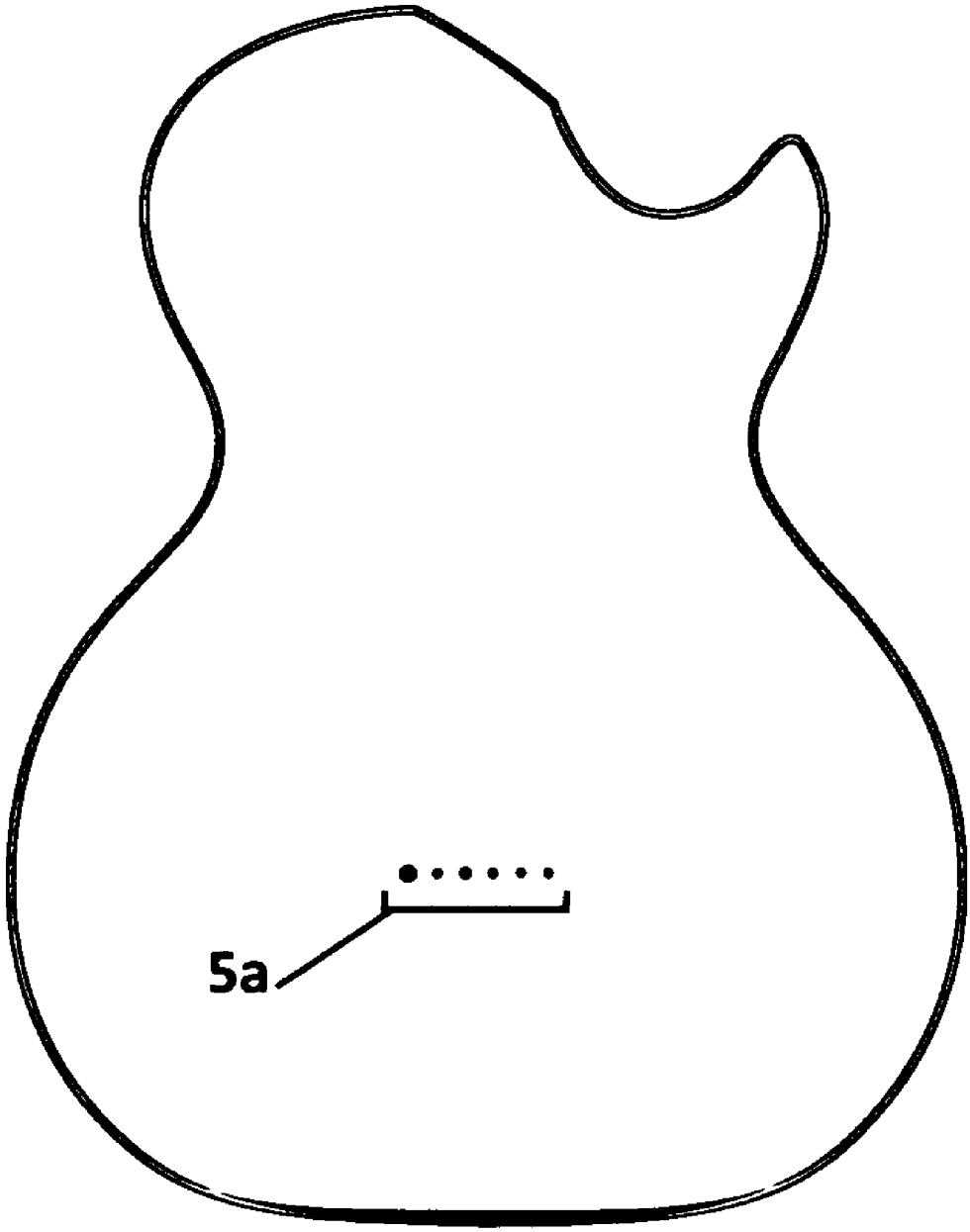
FIG. 5 is an illustration of the string guides near the bridge position on the present invention.

FIG. 5 is a diagram illustrating the string guides for the present invention. The unique string guide configuration (5*a*) can be drilled through-the-body or integrated into a tail piece. The guides must match or exceed the diameter of the respective strings which will pass through the guides. The unusual diameter combination further establishes the unique string configuration of the present invention.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A stringed musical instrument having the physical design of a six-string guitar that has a body, a neck, frets, a fret board on the neck, string anchors on the body and tuners at the end of the neck, comprising four guitar strings in the positions of strings 1, 2, 3, and 4 of the guitar and having the diameters expected for normal guitar strings and frets placed on the neck in the position expected for the guitar;

one banjo string in the position of string 5 and having the diameter expected of a banjo 5th string and a tuning expected of the banjo where the string has a capo type arrangement or tunneled string placed at the fifth fret position of the fretboard, limiting the sounding length of the string to the fifth fret;

one bass guitar string having a diameter larger than any guitar string and a string guide along the playable length of the string allowing for guiding a string of diameter larger than that of a guitar string from the string anchor on the body to the nut to the sixth string tuner.

* * * * *